US010900194B2

(12) United States Patent
Harazim

(10) Patent No.: US 10,900,194 B2
(45) **Date of Patent: *Jan. 26, 2021**

(54) SAFETY GRATE

(71) Applicant: HP Agency Pty Ltd, Molendinar (AU)

(72) Inventor: Paul Harazim, Main Beach (AU)

(73) Assignee: HP Agency Pty Ltd, Molendinar (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/716,563

(22) Filed: Dec. 17, 2019

(65) Prior Publication Data

US 2020/0141083 A1 May 7, 2020

Related U.S. Application Data

(63) Continuation of application No. 15/684,683, filed on Aug. 23, 2017, now Pat. No. 10,508,405.

(30) Foreign Application Priority Data

Aug. 23, 2016 (AU) ..... 2016101494

(51) Int. Cl.
*E02D 29/12* (2006.01)
*E02D 29/14* (2006.01)

(52) U.S. Cl.
CPC ..... *E02D 29/1463* (2013.01); *E02D 29/1427* (2013.01); *E02D 2220/00* (2013.01)

(58) Field of Classification Search
CPC ..... E02D 29/1427; E02D 29/1463; E02D 2220/00
USPC ..... 404/25; 52/19, 20
See application file for complete search history.

(56) References Cited

U.S. PATENT DOCUMENTS

| | | | | |
|---|---|---|---|---|
| 6,616,370 | B1 * | 9/2003 | Signorelli | B65D 90/48 404/25 |
| 7,303,354 | B1 * | 12/2007 | DeCroix | E02D 29/14 404/25 |
| 7,770,260 | B2 * | 8/2010 | Fumalle | E02D 29/14 16/254 |
| 8,579,541 | B2 * | 11/2013 | Thompson | E02D 29/1418 404/25 |
| 8,869,452 | B2 * | 10/2014 | Royer | E02D 29/1463 404/25 |
| 9,909,275 | B2 * | 3/2018 | Burr | E02D 29/1427 |
| 10,132,053 | B1 * | 11/2018 | Hughes | E02D 29/1463 |
| 2011/0150570 | A1 * | 6/2011 | Pickavance | E02D 29/14 404/25 |
| 2012/0037452 | A1 * | 2/2012 | Copeland | E04F 19/10 182/128 |
| 2012/0177440 | A1 * | 7/2012 | Chin | E02D 29/14 404/25 |
| 2014/0270943 | A1 * | 9/2014 | Blackowicz | E02D 29/1481 404/25 |
| 2015/0083164 | A1 * | 3/2015 | Suiter | B08B 9/023 134/22.11 |
| 2016/0168818 | A1 * | 6/2016 | Harazim | E02D 29/1463 404/25 |

* cited by examiner

*Primary Examiner* — Raymond W Addie
(74) *Attorney, Agent, or Firm* — Martin IP Pty Ltd

(57) ABSTRACT

A safety grill or grate for use with a camera and the like during maintenance.

15 Claims, 3 Drawing Sheets

SAFETY GRATE (1)

SAFETY GRATE

TECHNICAL FIELD

The present invention relates to an improved safety grate, particularly for use of a camera and the like during maintenance.

BACKGROUND

It is widely known in the industry that opening a manhole is a high risk and fatal activity that requires operators to erect approved safety equipment in order to adhere to current legislation. It is impractical and inefficient to erect and remove, in typical situations, safety barricades each time a manhole is needed to be inspected or maintenance to be carried out.

Manhole covers are heavy, typically circular, plates used to close vertical shafts, i.e. manholes. Manholes provide access to underground areas such as water and storm water pipes, sewage ways and other underground utility areas.

The following is a non-comprehensive list of the procedure to be administered during typical manhole maintenances.

Procedure prior to removal of manhole cover

Erect safety barricades for a safe working perimeter;

Set up your working equipment around perimeter such as cranes, tripods and certified anchor points;

Have all operators to be anchored to a certified anchor point; and

Use lever to remove the manhole cover.

Procedure post inspection or maintenance

Replace manhole cover;

Remove equipment and detach from certified anchor points; and Remove safety barricade.

However, a problem exists in present design of safety grills. Current grates are heavy to carry and cumbersome to handle.

Furthermore, current design of the manhole covers does not facilitate safe use of accessories such as cameras and hoses during work conducted by workers below ground level.

Consequently, it will be realized that the present invention will be a useful alternative to the costly and inefficient current safety grates in the inspection and maintenance of manhole operations as detailed below.

Summary of Invention Technical Problem

When operating around manholes and sewerage openings, barricades are erected to form a barrier so that no outside influences can affect the working environment. All workers below and above ground are to be harnessed to a certified anchor point at all times to prevent falls from heights into the confined space.

Furthermore, the grates are heavy to carry and load for transportation. Additionally, attachments and other peripheral equipment are required to perform tasks below ground. Moreover, there is no means to accommodate convenient and safe use of accessories such as cameras and hoses during work conducted by workers below ground level.

Solution to the Problem

A temporary safety manhole cover may be used whenever the common manhole cover is removed or any other water related opening. It is designed to eliminate the need of the existing maintenance procedure of setting up the manhole and being harnessed and anchored to a certified anchor point whilst works are carried out near or over openings. With this innovation, only the operator who is conducting maintenance below ground needs to be secured using a harness hooked up to a winch, which is secured to a certified anchor point situated above ground.

Furthermore, the design of the grate according to the present invention allows folding of the grate and provision to attach additional members such as rollers to accommodate cables and the like.

Advantages of the Invention

Facilitates use of accessories such as cameras and hoses

Bends and folds in half for ease of carry and transportation

Decreases risk of injury to both workers below and at top of ground

Eliminating the risk of falling from heights;

Reducing the set up time of the maintenance and/or inspection procedures;

Grate weighs less than existing manhole covers and can easily be removed and put back in place by a single road worker;

Corrosion resistant;

Cost effective to the cost and maintenance of existing fall from heights safety equipment and certified anchor points;

The cover is versatile and can be made to any shape to suit any application; and The manhole cover is typically circular in shape but manhole openings of other shapes including but not limited to rectangular and oval configurations.

BRIEF DESCRIPTION OF DRAWINGS

The innovation will be described by example only in reference to the accompanying drawings.

DETAILED DESCRIPTION

Any embodiment of the present invention is meant to be illustrative only and is not meant to be limiting the invention. It is to be understood that throughout the specification that the term "cover" and "grate"; "invention" and "innovation", will be used interchangeably.

The improved safety grate according to the present invention comprises:

(a) a grate adapted to bend or fold in half;

(b) A locking latch or lever member for opening or lifting of the grate from a manhole;

(c) An attachment such as a roller attached to the body of the grate to accommodate additional members such as a cable.

The grate when folded allows ease of handling of the grate.

Figure 1:
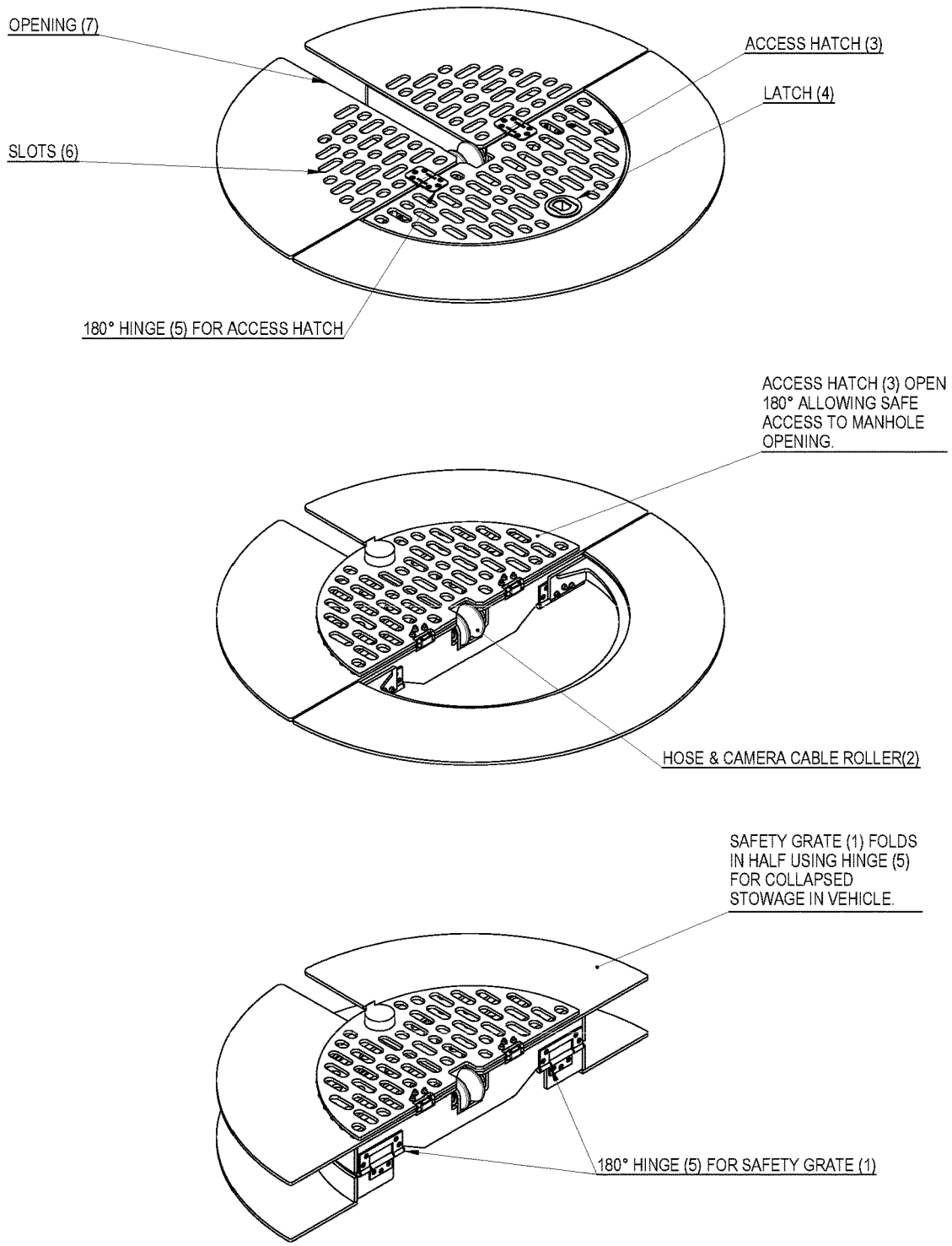
FIG. 1 shows the safety grate in both folded and unfolded positions as an embodiment of the present invention

FIG. 1 shows the safety grate in both folded and unfolded positions as an embodiment of the present invention.

The safety grate (1) replaces the permanent manhole cover during work such as maintenance and like being carried out by workers below ground level.

The grate has a cable roller (2) attached as shown to facilitate use of a camera or a hose to enable workers to conduct work below ground level.

The access hatch (3) opens at 180 degrees allowing safe access to manhole opening.

Latch (4) allows easy lifting or removal of the grate from the manhole.

Hinge member (5) is attached along the mid region of the grate (1) to secure the hatch (3) and enable orientation to 180 degrees to allow access to the manhole opening.

The slots (6) allow for natural light and airflow and it allows workers below ground to see through to the persons above; and vice versa. The slots (6) enhance ventilation below ground level.

The grate (1) conveniently and easily folds in half via hinge (5) allowing easy storage in vehicles during transportation, for example.

Figure 2:
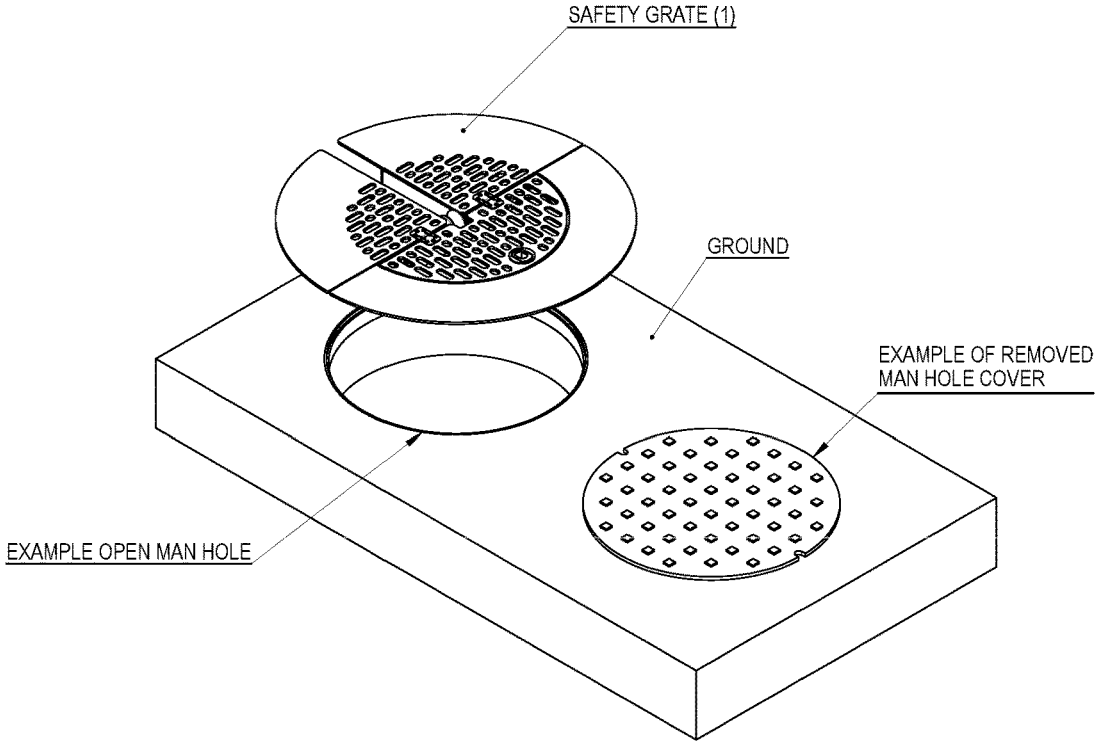
FIG. 2 shows the safety grate in operation as an embodiment of the present invention
Figure 2:
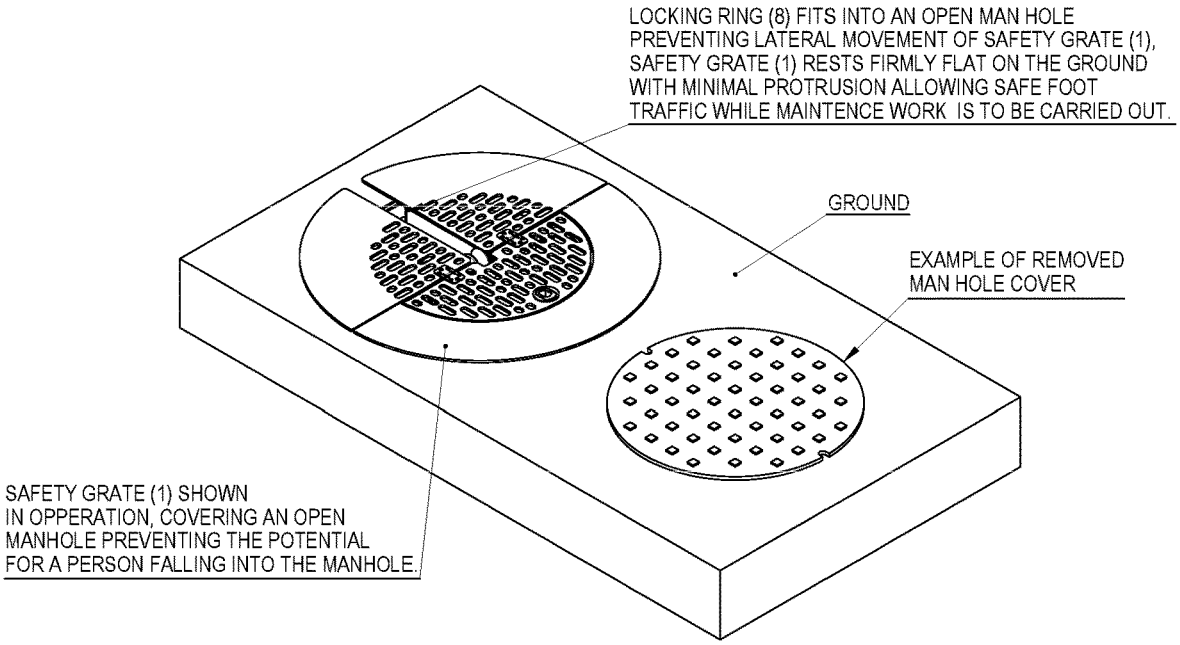

FIG. 2 shows the safety grate in operation as an embodiment of the present invention.

Locking ring (8) fits into an open man hole preventing lateral movement of safety grate (1).

Safety grate (1) rests firmly flat on the ground with minimal protrusion allowing safe foot traffic while maintenance work is to be carried out.

Figure 3:
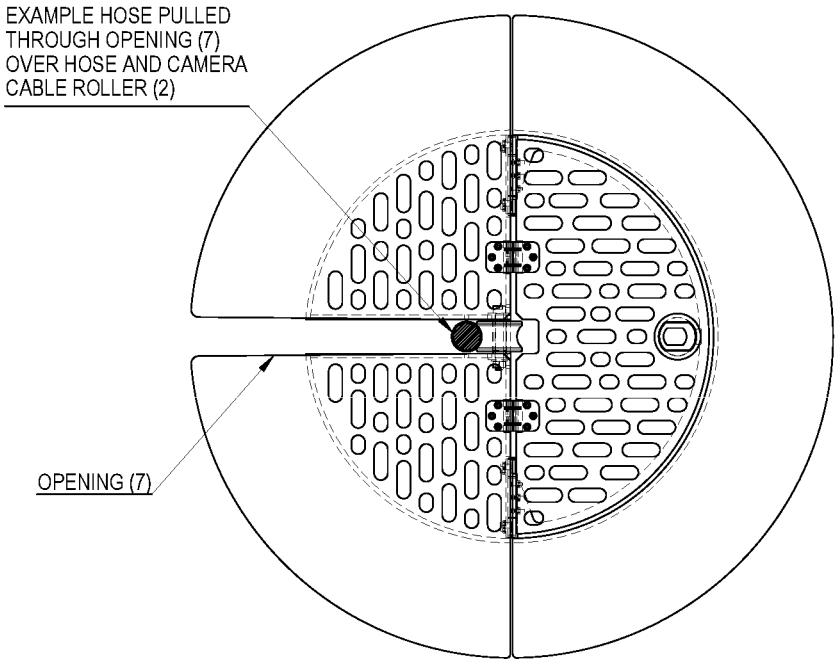
FIG. 3 shows the roller attached to the safety grate as an embodiment of the present invention
Figure 3:
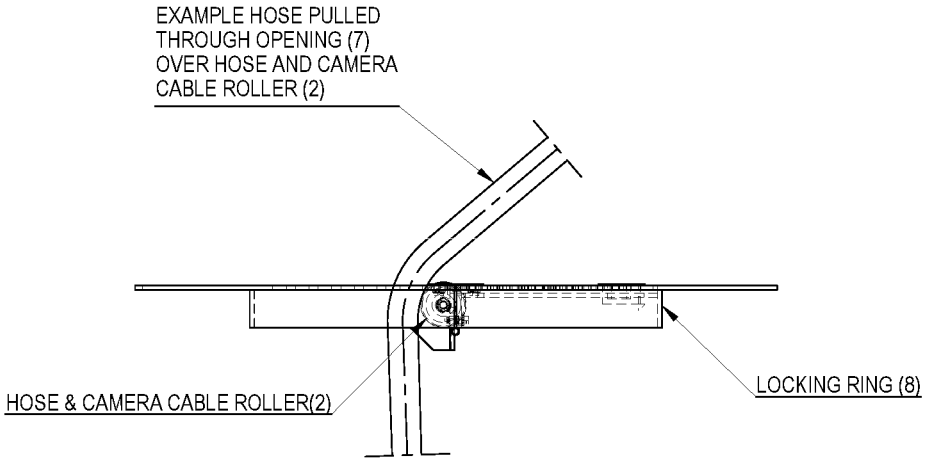

FIG. 3 shows roller attached to the safety grate as an embodiment of the present invention.

The hose may be pulled through the opening (7) over the hose and camera roller (2), for example.

Similarly, a camera may be pulled through the opening (7) over the hose and camera roller (2), for example.

The improved safety grate is a lightweight temporary safety manhole cover with a hinged access door made with aluminium or a strong nonferrous composite used when sewerage, storm water, water maintenance or inspections are required. It is a temporary self-ventilating design manhole grate to be used whenever the manhole cover is removed when operations are in progress around the manhole. The slots allow for natural light and airflow and it allows workers below ground to see through to the persons above; and vice versa.

The grate is designed to eliminate the risk of falling from heights regulations requirement whilst works are carried out near or over sewer openings by allowing the operators to walk freely above ground without having a harness to secure themselves.

The safety grate prevents large objects from falling into the confined space as the cover has been designed to exceed industrial safe load bearing weight standards. The safety grate also has a unique cut out slot design that allows for persons to move freely when cables are in use. In the alternative, the safety grate is embodied in a square form, and other shapes to suit any applications that may be required.

Traditionally these grates are composed of heavy metal and provide a hazard for workers on site. Folding of the grate and optionally providing means to hold or carry the grate for example via a hook type of member enables easy and safe handling of the grate.

Rollers are specifically designed to accommodate cables to relay items such as cameras and high pressure water jet rod fitting to below ground level. Rollers are designed to decrease injury to workers from high pressure water from jet rod both below and above ground level.

The improved grate provides full protection to workers and reduces injury to workers. For example, use of cables protects workers above ground from injury via jet rod heads which are delivered at high pressure. The cables restrict the motion and trajectory of attachments such as jet rod heads thereby reducing risk of injury.

The cable stops the head upon release from flying and injuring person above ground.

The improved grate comprises full length stainless steel hinges compared to a pin type of hinge.

The perimeter and edges of the grate may be protected by pvc type of material such as rubber.

It is preferable that the circular embodiment and temporary manhole grate (1) be formed of a lightweight material such as aluminium or even in some circumstances a suitably strong plastic or non-ferrous composite material.

Where the temporary manhole cover will be used in a situation where operators may walk over it then it may be necessary to stiffen the plate by forming the plate with stiffening ribs on the underside of the temporary cover. The ventilation slot (6) is laser cut.

The grate (1) is laser cut to drawing specifications and ventilation slots (6) are laser cut or via computer numeric control process. This can be realised in other shapes and embodiments of the current invention. In the alternative, when a strong plastic or non-ferrous composite is available, the use of 3D plastic injection molding may be used. The company logo will also be laser cut on the topside of the temporary manhole grate, for example.

A semi-concentric doorstop of the same material is welded to the topside to prevent the door from falling through. The doorstop and the invention is tested to industry weight load bearing specifications.

In the preferred embodiment or any other embodiment of the temporary manhole grate, it will be covered with a textured powder coating with a sand finish to give a non-slip texture.

Since the temporary manhole grate weighs less than 20 kg, it can be readily lifted into place by a single operator.

When the hatch is opened, equipment can be safely passed through to the operator working in the confined space. This is convenient, as it is not required to remove the entire manhole cover in order to pass equipment, which will compromise the safety of all operators working in and around the manhole.

It is to be understood that the invention is not limited to specific features shown or described since the means herein described comprises preferred forms of putting the invention into effect.

Therefore, it should be appreciated that various other changes and modifications can be made to any embodiment described without departing from the spirit and scope of the invention.

Variations

The grate (1) may be designed to accommodate different shapes and sizes, allowing for different materials such as non-metallic materials including but not limited to strong plastics and composites. The utilization of these materials include but not limited to the following advantages:

Resistance to a wide range of chemical agents including acid rain and salt spray, conditions under which metal parts would suffer. This results in much reduced maintenance and repair costs;

Low weight—with substantial savings in weight over similar metal parts (25% the weight of steel, 30% lighter than aluminium);

Thermal properties—composite structures act as very good insulators, whilst retaining their shape while not becoming brittle in cold temperatures;

Strength—comparable to aluminium and steel, strength characteristics of many materials;

Safety—fibre-reinforced composites are low in electrical conductivity and are efficient fire retardants; and Reduced cost—effective techniques have been developed which produce a post-mold paint-finish type surface which requires no further processing, thus eliminating the need for time consuming and expensive finishing.

The invention claimed is:

1. An improved safety grate comprising:

(a) a grate adapted to bend or fold in half, said grate having a main body;

(b) a locking latch or lever member for opening or lifting of the grate from a manhole;

(c) an attachment attachable to the main body of the grate to accommodate additional members;

(d) a plurality of ventilation slots in the main body of a cover;

(e) a load bearing hinged access door; and (f) a cover configured to sit on top of a lip of the manhole opening wherein the slots occupy a substantial portion of the cover to provide ventilation and light to a worker undertaking maintenance below ground; and at least one of the slots is substantially rectangular in shape and continuous from center to circumference of the cover.

2. The grate of claim 1, wherein said attachment is a roller.

3. The grate of claim 1, wherein the additional members includes a cable.

4. The grate of claim 1, wherein the grate is formed from a plastic material.

5. The grate of claim 1, wherein the grate is formed from aluminum.

6. The grate of claim 1, wherein the grate is formed from a non-ferrous composite material.

7. The grate of claim 1, wherein the cover has a perimeter that is circular.

8. The grate of claim 1, wherein the grate weighs less than 20 Kilograms.

9. The grate of claim 1, further comprising a rubber material around a perimeter of the grate for grate protection.

10. The grate of claim 1, wherein the grate includes a top having a doorstop.

11. The grate of claim 10, wherein said doorstop is semi-concentric.

12. The grate according to claim 1, wherein the grate includes a hinge member to facilitate folding in half of the grate.

13. The grate according to claim 12 wherein the hinge member is adapted to accommodate a cable.

14. The grate according to claim 13 wherein the cable allows a camera to be lowered into the ground.

15. The grate according to claim 14 wherein the cable allows a high pressure water hose to be lowered into the ground.

* * * * *